US005751815A

United States Patent [19]

Philp et al.

[11] Patent Number: 5,751,815

[45] Date of Patent: May 12, 1998

[54] APPARATUS FOR AUDIO SIGNAL STEREOPHONIC ADJUSTMENT

[75] Inventors: Adam Rupert Philp, Ealing; Alastair Sibbald, Maidenhead; Richard David Clemow, Gerrards Cross; Fawad Nackvi, Southall, all of England

[73] Assignee: Central Research Laboratories Limited, Middlesex, England

[21] Appl. No.: 663,317

[22] PCT Filed: Dec. 16, 1994

[86] PCT No.: PCT/GB94/02756

§ 371 Date: Jun. 21, 1996

§ 102(e) Date: Jun. 21, 1996

[87] PCT Pub. No.: WO95/17799

PCT Pub. Date: Jun. 29, 1995

[30] Foreign Application Priority Data

Dec. 21, 1993 [GB] United Kingdom ..... 9326092

[51] Int. Cl.[6] ..... H04R 5/00

[52] U.S. Cl. ..... 381/17; 381/24

[58] Field of Search ..... 381/25, 17, 63, 381/18, 24, 26, 1

[56] References Cited

U.S. PATENT DOCUMENTS 5,181,248 1/1993 Inaniga ..... 381/25
5,371,799 12/1994 Lowe ..... 381/25

FOREIGN PATENT DOCUMENTS 0 357 034 3/1990 European Pat. Off. .
1 598 746 9/1981 United Kingdom .

OTHER PUBLICATIONS

Jack Hebrank and D. Wright, "Spectral cues used in the localization of sound sources on the median plane", J. Acoust. Soc. Am., Vo. 56, No. 6, Dec. 1974, pp. 1829–1834.

*Primary Examiner*—Minsun Oh Harvey
*Attorney, Agent, or Firm*—Evenson, McKeown, Edwards & Lenahan, P.L.L.C.

[57] ABSTRACT

An audio signal balance control arranged is described in which, by utilizing binaural head related transfer functions, balance control beyond a first plane (22) in which two loudspeakers lie may be achieved. The transfer functions are derived from conventional artificial-head recording techniques with various attitudes of the artificial head in a further plane (25) normal to the first plane (22).

12 Claims, 5 Drawing Sheets

APPARATUS FOR AUDIO SIGNAL STEREOPHONIC ADJUSTMENT

The present invention relates to apparatus for adjusting audio signals for improving a stereophonic effect of reproduced sound.

It is known that to achieve balance control in a listening environment is desirable for listening to binaural or stereophonic recordings For example, a listener situated between two loudspeakers of a stereophonic hi-fi system and who is not positioned midway between the loudspeakers will, if these loudspeakers are operating at the same power output levels, receive imbalanced sound intensity levels at the left and right ears from the two loudspeakers. Thus by attenuating the power output of the loudspeaker nearer the listener, a balance between the received sound intensity levels may be achieved.

However, control of sound intensity levels on their own may not lead to a totally satisfactorily balanced sound-field. It is known to delay relatively the outputs of the loudspeakers so that each loudspeaker is apparently the same distance away from the listener regardless of their actual positions. This can be achieved by phase- or time-delay of the signals supplied to the loudspeakers. EP-A-0,357,034 discloses such a system. In this system an amplitude attenuator and a phase delay are serially connected in each of two stereophonic channels between a music source and a left and right loudspeaker. A balance control is manually adjusted so that attenuation and delay are concomitantly altered in each of the channels. This alteration is achieved by modifying the signals within each channel with values stored in memories. Thus the concomitant alteration permits apparent relative movement of the loudspeakers as well as control of the relative sound intensity level outputs of the loudspeakers.

GB-A-1598746 relates to a system in which a monophonic signal is converted to binaural signals providing positional information in the X-Y plane of the loudspeakers by means of a circuit located in the sound reproducing apparatus. The circuit includes variable attenuators, filters and delay elements which are under user control to create a desired sound-position effect.

Whilst the systems described in EP-A-0,357,034 and GB-A-1598746 function adequately to achieve balance in a sound-field between the two loudspeakers, this balance—and thus the sound field—is only adjustable in a plane in which the loudspeakers are situated.

However, there are situations where a stereophonic or binaural effect is diminished or degraded because of the relative position of the direction in a vertical azimuthal plane in which the listener is facing and an imaginary plane containing the loudspeakers and the listener's head. For example, if a listener is reclining on an armchair with his head inclined at an angle to the horizontal, then the ears will detect the sound is coming from a direction downward of the listener's head, and this may degrade the stereophonic effect.

The present invention relates generally to any type of reproduced sound having the quality of three dimensions, whether the sound is reproduced from monophonic, stereophonic or binaural signals; for the purposes of this specification such reproduced sound will be referred to as stereophonic.

It is an object of the present invention to provide a means of adjustment of stereophonic sound such that it is possible to compensate for the orientation of the listener's head relative to the sound transducers in a vertical azimuthal plane. Accordingly, the present invention provides audio signal adjustment apparatus including left and right signal channels for connection to respective left and right sound transducers, means within each channel for adjusting signal parameters for varying the stereophonic effect produced by the transducers, such adjusting means including azimuthal adjustment means for adjusting the stereophonic effect in dependence on the azimuthal orientation of the direction a listener's head is facing in relation to an imaginary plane containing the listener's head and the sound transducers, the azimuthal adjustment means including a filter means with a transfer function adjustable in dependence on a set of stored items of information relating to binaural head-related transfer functions (BHRTF) representing predetermined angles of said azimuthal orientation, and user operable means for selecting a desired item for modification of the filter transfer function.

Thus in accordance with the invention, the listener will have access to user-operable means, for example a set of keys on a remote control keyboard, or a joy-stick, or rotary control-knobs, which will permit the user to adjust the sound produced by the transducers to accommodate the orientation of the listener's head in an azimuthal plane relative to the transducers, for optimal stereophonic effect.

Preferably a filter is provided in each channel, preferably a programmable digital filter and a store is provided for storing said items, each item comprising a set of filter coefficients corresponding to a binaural head-related transfer function representing a predetermined angle of azimuthal orientation. A selector means, for example a processor, is provided to program the digital filter with a selected set of filter coefficients. Alternatively each filter means comprises a set of filters each having a respective binaural head-related transfer function and wherein respective ones of the set of filters are switched into the corresponding channel under the control of the controllable selector means.

The present invention will now be described, by way of example only and with reference to the accompanying drawings, of which:

DESCRIPTION OF THE PREFERRED EMBODIMENT

Figure 1:
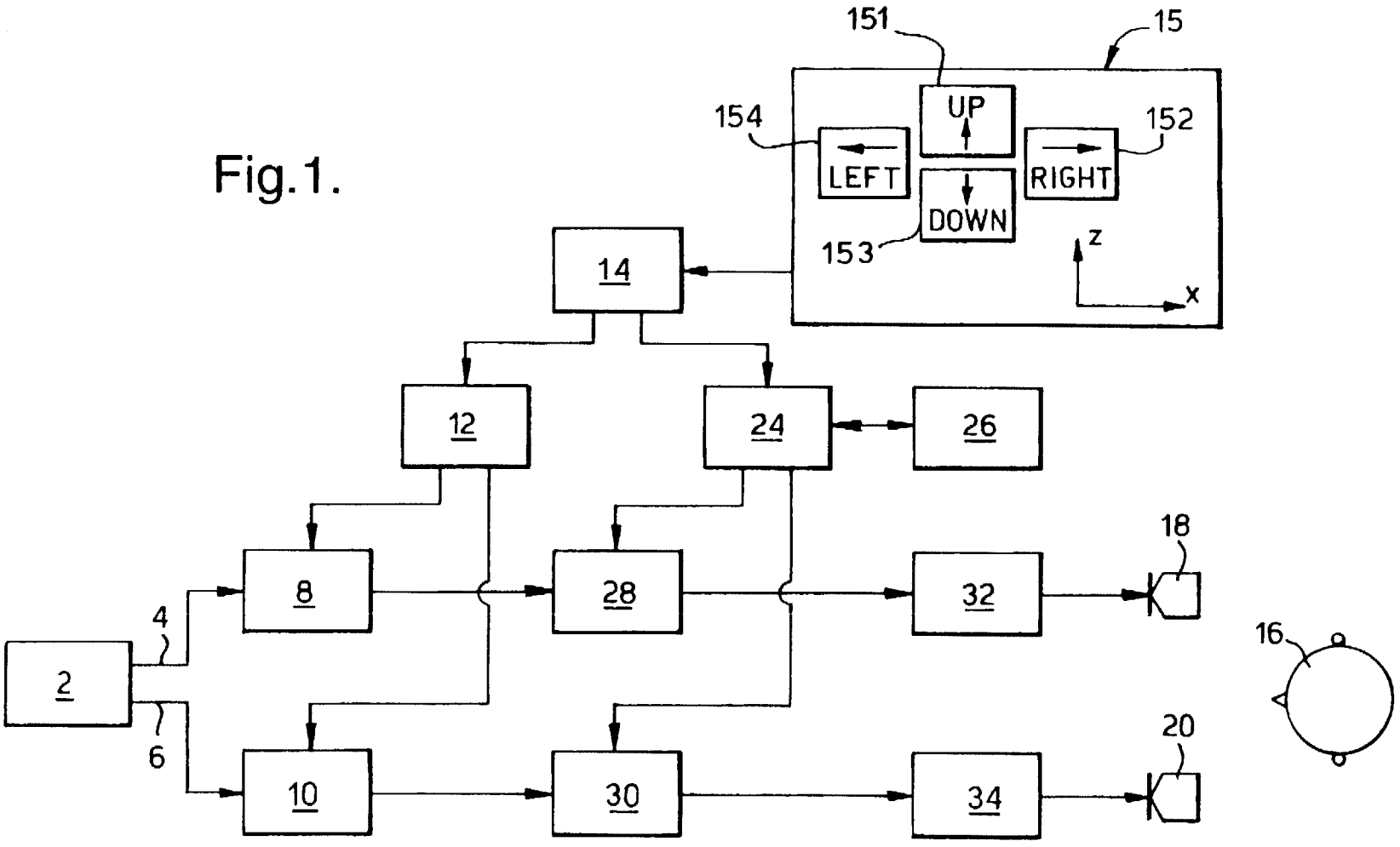
FIG. 1 illustrates a block diagram of an apparatus in accordance with the present invention.
Figure 2:
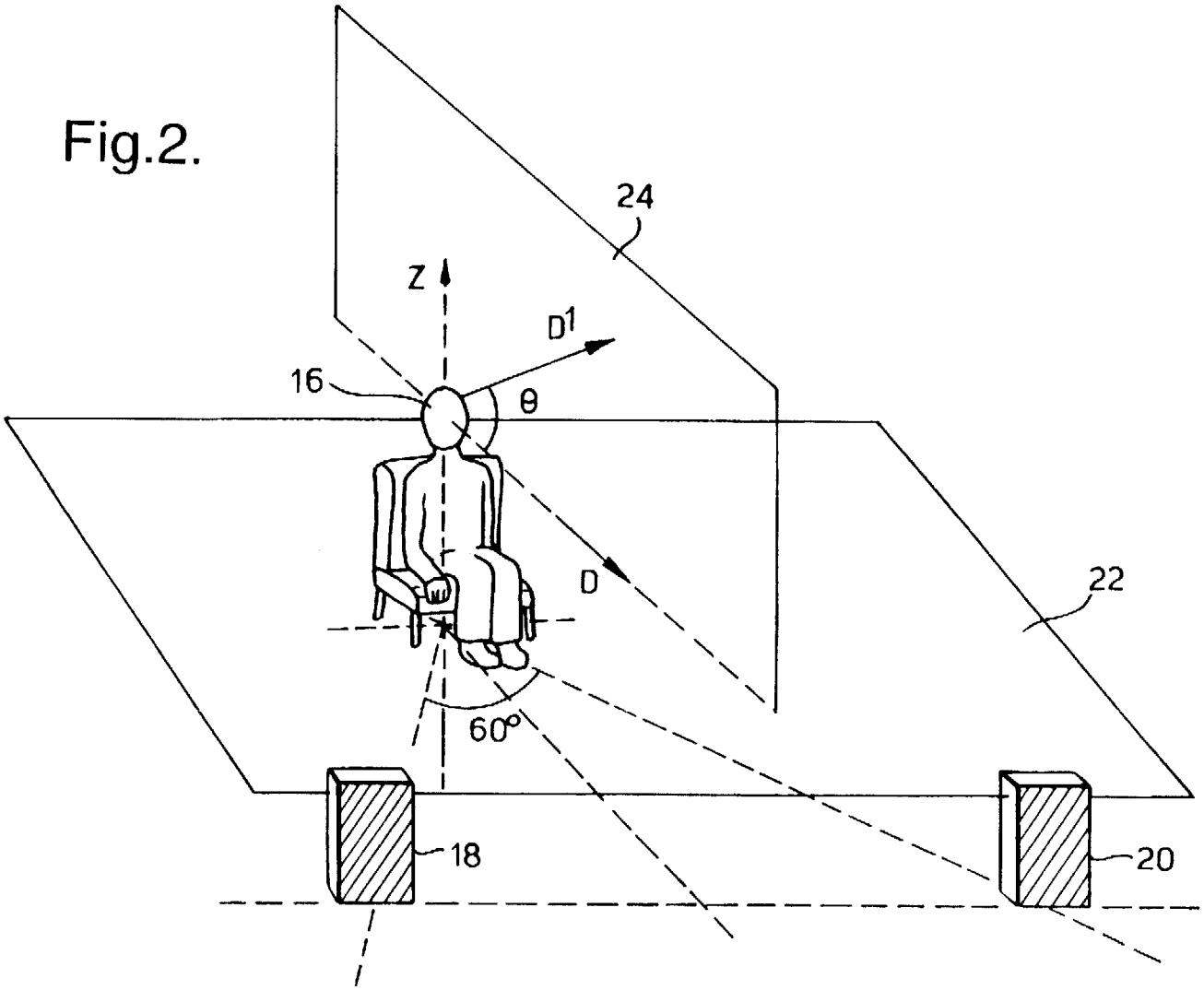
FIG. 2 is a schematic view of a listener and loudspeakers, indicating a reference plane and an azimuthal plane.

Referring to FIGS. 1 and 2 it will be seen that an apparatus for audio signal adjustment in accordance with the present invention includes an audio signal source 2 which provides, for example, conventional stereo audio signals or binaural signals, as a right signal and a left signal within respective signal channels.

The left and right signals pass through respective control means, comprising left and right time delays 8, 10 in channels 4, 6. The time delays 8, 10 are relatively variable.

The relative delay between the time delays 8, 10 is governed by a left-right balance control unit 12 which operates in dependence upon inputs received from a two-dimensional balance control interface 14. The interface 14 is controlled by a manually operable mechanism 15 as shown push buttons or keys of a remote control device. As an alternative to a push button arrangement, a manually operable joy-stick or rotary control knobs may be employed. Device 15 includes four keys or push buttons 151–154 indicating movement in two perpendicular directions, x indicated by the LEFT and RIGHT keys 152 and 154, and movement in the z direction or vertical azimuthal direction indicated by the two keys UP and DOWN 151 and 153. Hence, for example a depression of the LEFT key constrains interface 14 to provide an input to unit 12 representative of a predetermined amount of leftward movement of apparent sound. The unit 12 then causes time delay 8 to delay the right signal 4 relatively more than the time delay 10 delays the left signal 6 by an amount dependent on the number of times the LEFT key is depressed.

Signal channels 4, 6 include further control units to be described and are terminated at loudspeaker units 18, 20, positioned in conventional manner to the front and on either side of a listener 16.

FIG. 2 illustrates the geometric relationship between listener 16 and loudspeaker units 18, 20 more precisely. As is conventional, loudspeakers 18, 20 subtend an angle of about 60° with the head of the listener 16 in a reference plane 22 containing the speakers and the listener's head. A median plane 24 is indicated extending in a vertical (z) direction symmetrically through the head of the listener and between the loudspeakers 18, 20 which are positioned, equidistant on either side of plane 24. In ideal listening conditions, as indicated, the loudspeakers are directly ahead of the listener, with the listener sitting upright; the direction D in which the listener is facing extends midway between the speakers in a the reference plane 22. However, if for example, the listener is sitting in a reclined position, for example on an armchair, or alternatively sitting forward, then the facing direction $D^1$ makes a significant angle θ with the reference plane 22. For example, if the listener is reclining, then the loudspeakers will appear downward at an angle −θ to the facing direction of the listener. Alternatively, if the loudspeakers are positioned in an unusual position, for example near the top of a ceiling, then they will in any case be located above the head of the listener.

It is known that the sound sensation produced on a listener's ears depends on the direction in the median plane from which the sound originates, for example whether it is dead-ahead or directly above or behind the listener. The precise characteristics as a function of frequency of the sounds originating in the median plane have been measured empirically, and are shown for example in Journal of Acoustics Society of America, Vol 56, No 6, December 1974 "Spectral cues used in the localization of sound sources on the median plane," J. Hebrank and D. Wright, pages 1829–1934, FIG. 4 in particular. Such characteristics are also shown in FIGS. 3 and 4 of this application, to which reference is made below.

In accordance with the invention, the provision of UP and DOWN keys 151,153 on remote control device 15 permits adjustment of the audio signals to compensate for the position of the loudspeakers in the median plane of the listener's head. Thus, if the listener is reclining backwards, he may press the UP key a number of times until the sound produced by the loudspeakers appears to be coming from a position directly ahead of him.

Referring back to FIG. 1, the interface 14 provides appropriate control signals upon depression of the UP/DOWN keys 151,153 to a selector means 24. Selector means 24 comprises a processor which is coupled to a ROM memory store 26 which stores a plurality of sets of filter coefficients, each set corresponding to a particular binaural head-related transfer function for a particular orientation θ of the facing direction D relative to the reference plane 22 containing the loudspeakers and the head of the listener.

Figure 3:
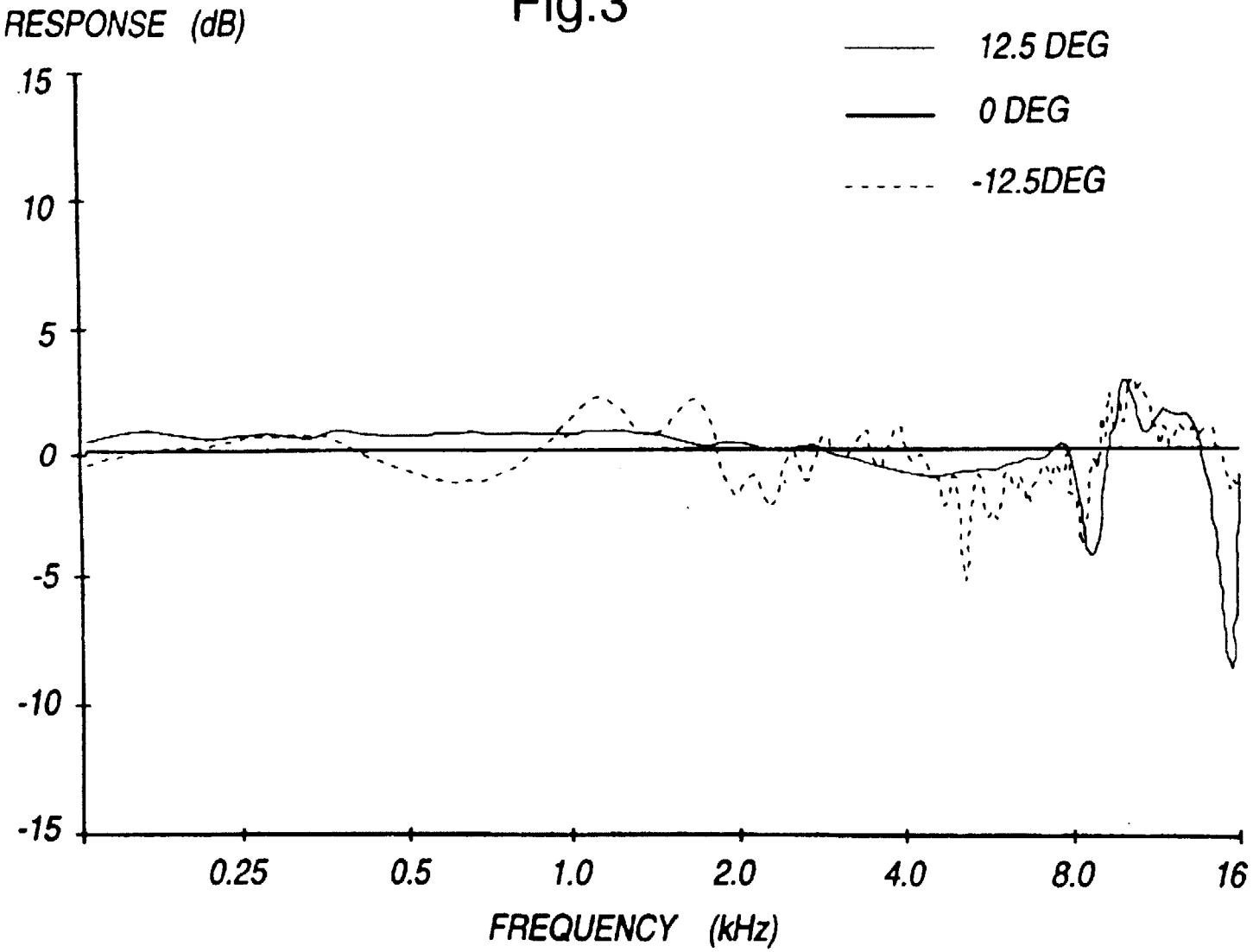
FIGS. 3 and 4 illustrate graphically sets of binaural head-related transfer functions for different orientations of a listener's head in the median plane.
Figure 4:
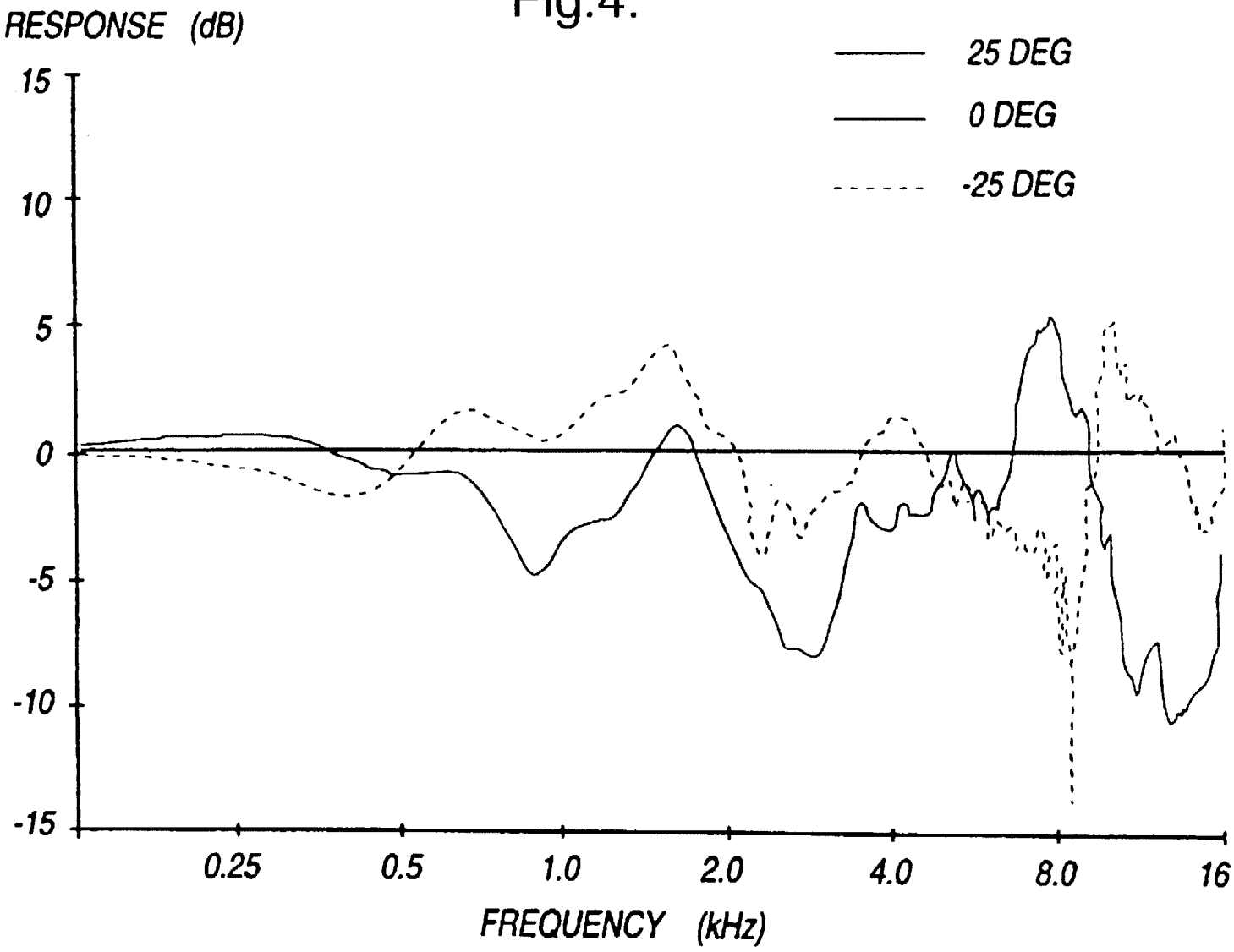

Referring to FIGS. 3 and 4 these illustrate the binaural head-related transfer functions for four different orientations in the median plane namely, ±12.5°, and ±25°. Thus in this example four different sets of filter coefficients are stored corresponding to these four orientations, together with a default dead-ahead position where all the filter coefficients are one. However, as many sets as are desired may be stored, for example, it may be desired to store the sets for ±10°, ±20° and ±30° representing six different sets. Processor unit 24 selects the appropriate set and supplies them to digital filters 28, 30 in the left and right channels 4, 6. The output of the digital filters 28, 30 are coupled to amplifier units 32, 34 and thence the audio signals are provided to loudspeaker units 18, 20.

Figure 5:
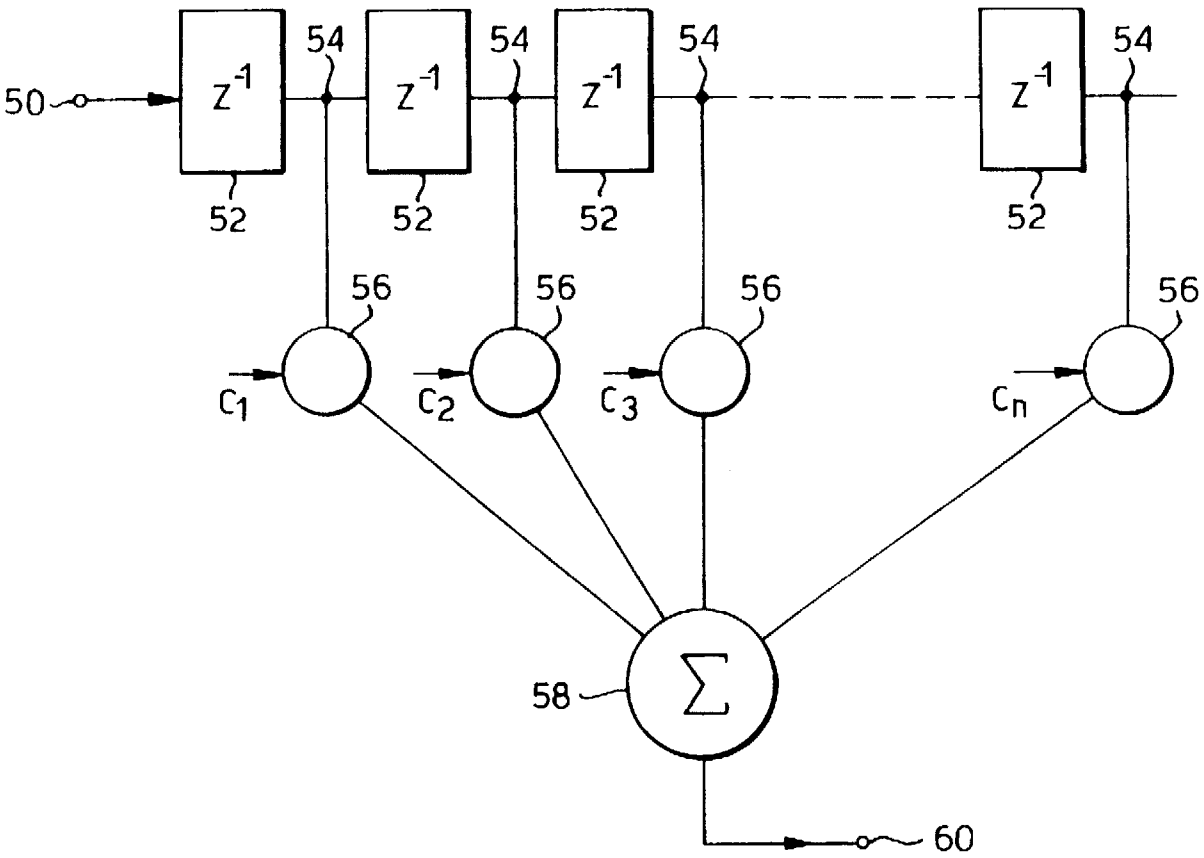
FIG. 5 is a schematic diagram of a digital filter used in the apparatus of FIG. 1.

Referring to FIG. 5, this is a diagrammatic representation of a digital filter showing an input 50, and chain of delay units 52 each having a delay of $Z^{-1}$, and tapping points 54 coupling the delayed signals through scaling units 56 in which the signals are multiplied by filter coefficients $C_n$ to a summing unit 58, and thence to an output 60. Thus it will be understood that processor 24 selectively provides different coefficients $C_n$ from memory 26 to the scaling units 56.

It will be appreciated that the filter means described above, that is the ROM 26 and each respective filter 28, 30, can readily take an alternative form. For example, each filter 28, 30 need not be a digital programmable filter, but may comprise a set of filters each having a respective BHRTF, such that respective ones of the set of filters may be switched into the corresponding signal channel and thereby modify the corresponding signals 4, 6. This switching is achieved under the control of the up-down balance control unit 24, as before.

Although in the above description the control means has been described as comprising time delays 8, 10, it will be understood that the control means is capable of controlling the gain and/or delay of signals 4, 6 and thus the time delays 8, 10 could be replaced by, or have in addition, variable, gain means.

Although in the above example the audio signal source 2 has been described as being conventional stereo, it will be understood that any suitable source may be employed. Examples are mono signals, ie. the left signal 4 and the right signal 6 are the same. Alternatively a binaural or processed binaural source may be employed (in which case balance control within the plane 22 may be achieved beyond the spatial boundaries of the loudspeakers 18, 20).

We claim:

1. Audio signal adjustment apparatus including left and right signal channels for connection to respective left and right sound transducers, means within each channel for adjusting signal parameters for varying the stereophonic effect produced by the transducers, such adjusting means including azimuthal adjustment means for adjusting the stereophonic effect in dependence on the azimuthal orientation (θ) of the facing direction (D) of a listener's head in relation to a reference plane containing the listener's head and the sound transducers, the azimuthal adjustment means including a filter means with a transfer function adjustable in dependence on a set of stored items of information relating to binaural head-related transfer functions representing predetermined angles of said azimuthal orientation, and user operable means for selecting a desired item for modification of the filter transfer function, wherein the stored items represent functions at ±12.5°, ±25° from the reference plane.

2. Audio signal adjustment apparatus including left and right signal channels for connection to respective left and right sound transducers, means within each channel for adjusting signal parameters for varying the stereophonic effect produced by the transducers, such adjusting means including azimuthal adjustment means for adjusting the stereophonic effect in dependence on the azimuthal orientation (θ) of the facing direction (D) of a listener's head in relation to a reference plane containing the listener's head and the sound transducers, the azimuthal adjustment means including a filter means with a transfer function adjustable in dependence on a set of stored items of information relating to binaural head-related transfer functions representing predetermined angles of said azimuthal orientation, and user operable means for selecting a desired item for modification of the filter transfer function, wherein the stored items represent functions at ±10°, ±20°, ±30° from the reference plane.

3. Audio signal adjustment apparatus including left and right signal channels for connection to respective left and right loudspeakers which are spaced apart from a listener and are located relative to the listener's head to produce a three dimensional sound field, with a source of sound from the loudspeakers being positioned in a reference plane which includes an azimuthal plane of the listener's head lying parallel to a direction in which the listener faces, signal adjusting means within each channel operable to adjust signal parameters for varying a stereophonic effect produced by the loudspeakers in dependence on an orientation of said azimuthal plane relative to the reference plane when the listener's head is tilted relative to the reference plane, said adjusting means including a store means for storing sets of filter coefficients, each set of which corresponds to a particular binaural head related transfer function (HRTF) for a particular orientation of the azimuthal plane relative to the reference plane, and user operable selection means operable to select one or more sets of filter coefficients thereby to vary the stereophonic effect of the loudspeakers and effect apparent movement of the three dimensional sound field to re-align it with the azimuthal plane of the listener's head when the listener's head is tilted relative to the reference plane.

4. Apparatus according to claim 3, wherein the signal adjusting means includes filter means with a transfer function adjustable in dependence on a set of stored items of information relating to binaural head related transfer functions representing predetermined angles of orientation of said azimuthal plane.

5. Apparatus according to claim 3, wherein the stored items represent functions at ±12.5°, ±25° from the reference plane.

6. Apparatus according to claim 3, wherein the stored items represent functions at ±10°, ±20°, ±30° from the reference plane.

7. Apparatus according to claim 3 wherein said filter means comprises a filter (28,30) in each signal channel.

8. Apparatus according to claim 7 wherein each filter comprises a programmable digital filter and including a selector means (24) under control of said user operable means for selecting said items of information from a store (26), each item of information comprising a set of filter coefficients for the digital filter representing a respective binaural head-related transfer function and wherein, under the control of the selector means, the digital filter is programmable with the filter coefficients.

9. Apparatus according to claim 3 wherein the user operable means includes a set of keys (151–154) for selecting said desired item, the keys being arranged such that depression of a predetermined key a predetermined number of times selects an item of information which is said predetermined number of items away from the item currently in use.

10. Apparatus according to claim 3 including a variable time-delay (8,10) in each channel and control means operable in response to said user operable means for selectively varying the time delays for adjusting the apparent direction of source of sound.

11. Audio signal adjustment apparatus for use by a listener wherein left and right loudspeakers are spaced from the listener and are located relative to the listener's head to produce a three-dimensional sound field, with a source of the sound from the loudspeakers being positioned in a reference plane which includes an azimuthal plane of the listener's head lying parallel to a direction in which the listener faces, comprising:

left and right signal channels coupled to the respective left and right loudspeakers providing audio signals thereto;

a signal adjusting circuit coupled within each channel to adjust signal parameters for varying a stereophonic effect produced by the loudspeakers in dependence on an orientation of said azimuthal plane relative to the reference plane when the listener's head is tilted relative to the reference plane, and including a storage device having stored therein sets of filter coefficients, each set of which corresponds to a particular binaural head related transfer function for a particular orientation of the azimuthal plane relative to the reference plane; and a user operable selector coupled to the signal adjusting circuit allowing the listener to select one or more of said sets of filter coefficients to vary the stereophonic effect produced by the loudspeakers and effect apparent movement of the three-dimensional sound field to realign it with the azimuthal plane of the listener's head when the listener's head is tilted relative to the reference plane.

12. Apparatus according to claim 11, wherein the signal adjusting circuit further comprises a filter in each channel having a transfer function adjustable in dependence on a set of stored items of information relating to binaural head related transfer functions representing predetermined angles of orientation of said azimuthal plane.

* * * * *